United States Patent [19]

Schank

[11] Patent Number: 4,565,760

[45] Date of Patent: Jan. 21, 1986

[54] PROTECTIVE OVERCOATINGS FOR PHOTORESPONSIVE IMAGING MEMBERS

[75] Inventor: Richard L. Schank, Webster, N.Y.

[73] Assignee: Xerox Corporation, Stamford, Conn.

[21] Appl. No.: 670,710

[22] Filed: Nov. 13, 1984

[51] Int. Cl.[4] ..... G03G 5/14

[52] U.S. Cl. ..... 430/66; 430/67

[58] Field of Search ..... 430/66, 67; 428/412, 428/477; 525/10, 33, 477

[56] References Cited

U.S. PATENT DOCUMENTS

| | | | |
|---|---|---|---|
| 2,901,349 | 8/1959 | Schaffert et al. | 96/1 |
| 3,434,832 | 3/1969 | Joseph et al. | 96/1.5 |
| 4,277,287 | 7/1981 | Frye | 106/287.12 |

FOREIGN PATENT DOCUMENTS 111734 3/1977 Japan .

*Primary Examiner*—John L. Goodrow
*Attorney, Agent, or Firm*—E. O. Palazzo

[57] ABSTRACT

A photoresponsive imaging member with acceptable residual voltages at from about 20 percent to about 80 percent relative humidities consisting of inorganic or organic photoconductive substances, and as a release protective coating thereover a dispersion of colloidal silica and a hyroxylated silsesquixone in an alcoholic medium, which overcoating is of a thickness of from about 0.2 micron to about 1.5 microns.

14 Claims, No Drawings

PROTECTIVE OVERCOATINGS FOR PHOTORESPONSIVE IMAGING MEMBERS

BACKGROUND OF THE INVENTION

This application is a continuation-in-part of U.S. Ser. No. 346,423 filed on Feb. 5, 1982, and entitled Protective Overcoatings for Photoresponsive Devices. The disclosure of this application is totally incorporated herein by reference.

This invention is generally directed to an electrostatographic imaging member or device, containing certain silicone-silica hybrid crosslinked polymers; and more specifically, the present invention is directed to inorganic and organic photoresponsive devices with silicone-silica hybrid overcoatings. These overcoatings function primarily as a physical and chemical protectant for the photoresponsive member, and further allow the achievement of excellent release and transfer of toner images from such members. Also, the imaging member comprised of silicone-silica hydrid overcoatings of certain critical thicknesses possess acceptable residual voltages.

The formation and development of images utilizing photoresponsive devices is well known, one of the most widely used processes being xerography. In these processes the electrostatic latent image is developed by applying toner particles thereto, and subsequently the developed image is transferred to a permanent substrate such as paper. Development can be accomplished by a number of various known techniques including cascade development, powder cloud development, magnetic brush development, liquid development, and the like.

Recently there has been disclosed for use in xerographic imaging systems, inclusive of those with a double charging process, overcoated layered inorganic and organic imaging members. One of these members comprises a substrate, a hole injecting layer overcoated with a hole transport layer, and a photogenerating layer, followed by an insulating organic resin top coating. These devices have been found to be very useful in various imaging systems, and have the advantage that high quality images are obtained, with the overcoating acting primarily as a protectant. The details of this type of overcoated photoreceptor device is fully described in U.S. Pat. No. 4,251,612, on Dielectric Overcoated Photoresponsive Imaging Member and Imaging Method, the disclosure of which is totally incorporated herein by reference.

In one preferred method of operation as described in the aforementioned patent, the layered photoresponsive member is charged a first time with electrostatic charges of negative charge polarity, subsequently charged a second time with electrostatic charges of a positive polarity for the purpose of substantially neutralizing the charges residing on the electrically insulating surface of the member, followed by exposing the member to an imagewise pattern of activating electromagnetic radiation thereby forming a visible image, which is transferred to a receiving member. The photoresponsive device may subsequently be reused to form additional reproductions after erasure and cleaning have been accomplished.

There are also disclosed in the prior art various imaging devices with polysiloxane compounds. For example, U.S. Pat. No. 4,181,772 discloses an overcoated photoreceptor device, with an adhesive generating layer comprised of a photogenerating pigment dispersed in a copolymer of a siloxane and a dihydroxy compound, the copolymer being of the formula as illustrated in column 2, beginning at around line 60. This layer thus functions as a photogenerator, and as an adhesive in organic photoresponsive devices, thereby eliminating the need for additional adhesive layers while simultaneously allowing excellent generation of positive charges. Also, there is described in U.S. Pat. No. 3,861,915 solvent soluble block copolyesters of polysiloxanes of the type as illustrated in column 3, beginning at line 20. It is indicated in this patent that such block copolymers have excellent leveling and release properties, and can be used as additives in electrophotographic compositions for single layer planographic printing plates, which may be utilized directly without the necessity of a fountain solution, and which eliminate the problem of migration of sensitizing dyes in photoconductors. There is further disclosed in thhis patent that the novel copolyester polysiloxane copolymers are useful in single layer reusable electrophotographic films with improved surface characteristics, including the prevention of excessive wear.

Furthermore, disclosed in U.S. Pat. No. 4,009,032 are improved waterless lithographic plates, which are comprised of a copolymer of siloxane blocks crosslinked to an elastomeric ink releasing condition and organic thermoplastic blocks which are ink accepting. More specifically, there is disclosed in this patent that a master comprising a conventional substrate and an overlying layer of a copolymer having siloxane blocks crosslinked to an ink releasing elastomeric condition, and ink accepting organic thermoplastic blocks can be imaged with particulate imaging material, by softening the thermoplastic blocks, followed by hardening to bond the particular imaging material thereto. Thus, according to the teachings of this patent, the thermoplastic blocks permit the imaging material to be physically bonded thereto, and the siloxane blocks provide an insoluble ink releasing background area in order that no dampening or fountain solution is required. Similar teachings are present in U.S. Pat. Nos. 3,886,865; 3,865,588; and 3,775,115.

There is also disclosed in U.S. Pat. No. 4,371,600 release photoresponsive members with overcoatings comprised of certain crosslinked siloxy coupled dihydroxy compounds, such as bis-phenol-A copolymers. More specifically, there is described in this patent certain crosslinked siloxy coupled dihydroxy copolymers, having a molecular weight of from about 2,000 to about 250,000, and preferably from about 40,000 to about 100,000. These materials allow rapid release and transfer of toner particles from photoresponsive members to a permanent substrate.

Other prior art includes U.S. Pat. No. 4,277,287, which discloses silicone resin protective coatings for polycarbonates, metal substrates, glass, wood and the like, reference the teaching in column 6, beginning at line 4; U.S. Pat. No. 3,434,832 which describes a photoconductive member with a protective coating of a film forming resin and at least one metallic stearate; U.S. Pat. No. 2,901,349; and Japanese Publication No. 011734 of September 1978 to Toray Industries, Inc.

When selecting certain organic or inorganic photoresponsive members for different imaging systems, various problems, which are detrimental to the performance and the life of the photoreceptor from both a physical and chemical contamination standpoint can be encountered. Thus, for example, organic amines, mercury vapor, or human fingerprints can cause crystallization of amorphous selenium photoreceptors resulting in undesirable copy quality and copy deletion. In addition, physical problems such as scratches on both organic and inorganic photoresponsive devices can cause unwanted printout on the final copy. Furthermore, organic photoresponsive devices sensitive to oxidation, and subjected to electric charging devices can suffer reduced useful life in a machine environment. Also, with certain overcoated organic photoreceptors, various problems have been encountered with regard to the development and transfer of the images involved. Thus, for example, the toner materials used for development do not release sufficiently from the photoresponsive surface leaving unwanted toner particles thereon causing such particles to be subsequently embedded into, or transferred from the imaging surface in later imaging steps resulting in undesirable images of low quality and/or high background. In some instances the dry toner particles also adhere to the imaging member in print background areas due to the adhesive attraction of the toner particles to the photoreceptor surface. This can be particularly troublesome when most silicone elastomeric polymers or resins are employed as photoreceptor overcoating materials for their toner release characteristics. Therefore, low molecular weight silicone components can migrate to the surface of the polymer layer and act as an adhesive toward dry toner particles brought in contact therewith during the image development step. There thus results undesirable high background prints since the toner particles, along with the toner image, are efficiently transferred to the receiving sheet when, for example, simultaneous transfer and fixing is thermally accomplished. The imaging members of the present invention eliminate many of these prior art problems.

SUMMARY OF THE INVENTION

It is a feature of the present invention to provide improved overcoated photoresponsive members which overcome many of the above-noted disadvantages.

In another feature of the present invention there is provided a silicone-silica hybrid crosslinked polymer overcoating for photoresponsive devices, which overcoating allows for both the physical and chemical protection of such devices, and for the excellent release and transfer of toner particles from the imaging surface involved.

Yet another feature of the present invention is the provision of certain silicone-silica hybrid polymers which when overcoated on photoresponsive devices, including disposable photoresponsive devices, prevent sticking of the toner particles to the photoresponsive layers.

These and other features of the present invention are accomplished by the provision of photoresponsive members, including inorganic and organic members or devices, especially layered organic photoresponsive devices, which have been overcoated with commercially available silicone-silica hybrid crosslinked polymers. More specifically, in one embodiment, the present invention is directed to photoresponsive devices comprised of inorganic materials, such as selenium, selenium alloys, including arsenic selenium, and tellurium selenium, halogen doped selenium, halogen doped selenium alloys; or layered overcoated photoresponsive imaging members comprised of an electrically conductive substrate overcoated with a layer capable of injecting holes into a layer on its surface, this layer being comprised of carbon black or graphite dispersed in a polymer; a hole transport layer in operative contact with the layer of hole injecting material; overcoated with a layer of charge generating material comprised of inorganic or organic photoconductive substances, this layer being in contact with the charge transport layer; a layer of an insulating organic resin; and as a top layer for such devices a silicone-silica hybrid crosslinked polymer. Other organic photoresponsive devices embraced within the scope of the present invention include those comprised of a substrate, a photogenerating layer, such as trigonal selenium, or vanadyl phthalocyanine, and a transport layer, reference U.S. Pat. No. 4,265,990, the disclosure of which is totally incorporated herein by reference; and as a top layer for these devices a silicone-silica hybrid crosslinked polymer.

In one specific embodiment of the present invention there is provided an organic layered photoconductive imaging member consisting of a photogenerating layer and an aryl amine charge transport layer in contact therewith, which imaging member further contains thereover a protective overcoating in a certain thickness consisting of a dispersion of colloidal silica and a hydroxylated silsesquioxane in an alcoholic medium.

Examples of silicone-silica hybrid polymers that are useful in the present invention include those materials commercially available from Dow Corning, as Vestar Q9-6503; from General Electric, as SHC-1000, SHC-1010; and the like. More specifically, the silicone-silica hybrid crosslinked polymers referred to herein have been characterized as a dispersion of colloidal silica and a hydroxylated silsesquioxane in an alcoholic medium.

The silicone-silica hybrid polymers of the present invention are applied to the photoresponsive devices as separate thin coatings in a critical thickness of from about 0.2 microns to about 1.5 microns, and preferably in a thickness of about 1.0 micron. Generally, these polymers are applied by known methods to the top layer of the photoresponsive members, inclusive of blade coating, dip or flow coating, or spraying with a suitable solvent or solvent mixture. Solvent mixtures containing, for example alcohols, can be used with excellent results for both organic and inorganic photoreceptor devices. The silicone-silica hybrid crosslinked polymers of the present invention are applied to photoresponsive devices primarily for protection purposes, and for assisting in the release and transfer of toner particles from such devices. Also, the resulting photoreceptor members possess stable desirable electrical properties, and specifically acceptable residual voltages of from about 10 volts to about 150 volts of relative humidities of from about 20 percent to about 80 percent.

With further reference to the layered imaging members of the present invention, the substrate selected can be opaque or substantially transparent, and may comprise non-conducting materials such as inorganic or organic polymeric materials; a layer of an organic or inorganic material having a conductive surface layer arranged thereon, inclusive of aluminized Mylar, or a conductive material like aluminum, nickel, brass or the like. The substrate is preferably flexible, however, it may also be rigid and can assume many different configurations such as a plate, a cylindrical drum, an endless belt, and the like. The thickness of the substrate layer can be over 100 mils, but is preferably from about 3 mils to about 10 mils.

When used, the hole injecting electrode layer can be comprised of many substances which are capable of injecting charge carriers under the influence of an electrical field. These substances include, for example, gold, and graphite, and preferably carbon black or graphite dispersed in various polymer resins. Illustrative examples of polymers that can be selected as the material within which the carbon black or graphite is dispersed include polyesters such as PE-100 commercially available from Goodyear Company, as well as those polyester materials that are polymeric esterification products of a dicarboxylic acid and a diol comprising a diphenol, such as 2,2-bis(3-beta hydroxy ethoxy phenyl)propane, 2,2-bis(4-hydroxyisopropoxyphenyl)propane, 2,2-bis(4-beta hydroxy ethoxy phenyl)pentane, and the like, while typical dicarboxylic acids are oxalic acid, malonic acid, succinic acid, phthalic acid, and terephthalic acid. The ratio of polymer to carbon black or graphite is from about 0.5:1 to 2:1, with the preferred ratio being about 6:5. Also, the hole injecting layer is of a thickness of from about 1 micron to about 20 microns, and preferably from about 4 microns to about 10 microns.

The charge carrier transport layer can be selected from numerous suitable materials which are capable of transporting holes, this layer generally having a thickness of from about 5 to about 50 microns, and preferably from about 20 to about 40 microns. The transport layer preferably comprises molecules of the formula:

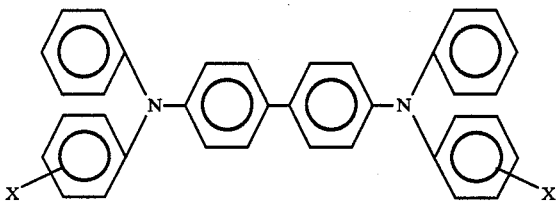

dispersed in a highly insulating and transparent organic resinous material wherein X is an alkyl group, or a halogen inclusive of being selected from the group consisting of (ortho)$CH_3$, (meta)$CH_3$, (para)$CH_3$, (ortho)Cl, (meta)Cl, and (para)Cl. This charge transport layer is substantially non-absorbing in the spectral region of inended use, but is "active" in that it allows injection of photogenerated holes from the charge generator layer. The highly insulating resin, which has a resistivity of at least $10^{12}$ ohm-cm to prevent undue dark decay, is a material which is not necessarily capable of supporting the injection of holes from an injecting or generator layer. However, the resin becomes electrically active when it contains from about 10 to 75 weight percent of the substituted N,N,N',N'-tetraphenyl-[1,1'-biphenyl]4-4'-diamines corresponding to the foregoing formula. Specific diamines include, for example, N,N'-diphenyl-N,N'-bis-(alkylphenyl)-[1,1-biphenyl]-4,4'-diamine wherein alkyl is selected from the group consisting of methyl, such as 2-methyl, 3-methyl and 4-methyl, ethyl, propyl, butyl, hexyl and the like. With chloro substitution, the amine is N,N'-diphenyl-N,N'bis(halo phenyl)-[1,1'-biphenyl]-4,4'-diamine, wherein halo is 2-chloro, 3-chloro or 4-chloro.

Other electrically active small molecules which can be dispersed in the inactive resin to form a layer which will transport holes include triphenylmethane, bis-(4-diethylamino-2-methylphenyl)phenylmethane, 4',4''-bis(diethylamino)-2',2''-dimethyltriphenyl methane, bis-4(-diethylamino phenyl)phenylmethane, and 4,4'-bis(-diethylamine)-2',2''-dimethyltriphenylmethane.

The photogenerating pigments can include, for example, pyrrilium dyes, and numerous photoconductive charge carrier generating compounds, providing that they are electronically compatible with the charge carrier transport layer, that is, they can inject photoexcited charge carriers into the transport layer, and charge carriers can travel in both directions across the interface between the two layers. Particularly useful charge carrier generating materials are amorphous and trigonal selenium, selenium-arsenic and selenium-tellurium alloys, and organic charge carrier generating materials, such as metal free phthalocyanines; for example, the X-form of phthalocyanine, metal phthalocyanines, and vanadyl phthalocyanine. These materials can be used alone or as a dispersion in a polymeric binder. This layer is typically from about 0.5 to about 10 microns or more in thickness. Generally, it is desired to provide this layer in a thickness which is sufficient to absorb at least 90 percent (or more) of the incident radiation which is directed upon it in the imagewise exposure step. The maximum thickness is dependent primarily on factors such as mechanical considerations, that is whether a flexible photoreceptor is desired.

The electrically insulating layer selected for the imaging member with a hole injection layer typically has a bulk resistivity of from about $10^{12}$ to about $5\times10^{14}$ ohm-cm, and is from about 5 to about 25 microns in thickness. Generally, this layer can also function as a protectant in that the charge carrier generating layer is kept from being contacted by toner particles and ozone, which is generated during imaging. Typical suitable insulating materials include Mylar (a polyethylene terephthalate film available from E. I. duPont deNemours), polyethylenes, polycarbonates, polystyrenes, polyesters, polyurethanes and the like.

In one imaging sequence, the five layered ovecoated photoresponsive device described hereinbefore, and containing as a top layer the silicone-silica hybrid cross-linked polymers described herein, is electrically charged negatively a first time in the absence of illumination, resulting in negative charges residing on the surface thereof. An electric field is thus established across the photoreceptor device, and as a result of this field, holes are injected from the charge carrier injecting electrode layer into the charge carrier transport layer, which holes are transported into the charge carrier generating layer. These holes travel through the generating layer until they reach the interface between the charge carrier generator layer and the electrically insulating overcoating layer where such charges become trapped; and as a result of this trapping at the interface, there is established an electrical field across the electrically insulating overcoating layer. Generally, this charging step is accomplished with from about 10 volts/micron to about 100 volts/micron.

Subsequently, the device is charged a second time in the absence of illumination, but with a polarity opposite to that used in the first charging step thereby substantially neutralizing the negative charges residing on the surface. After the second charging step with a positive polarity, the surface is substantially free of electrical charges, that is, the voltage across the photoreceptor member upon illumination is brought to substantially zero. As a result of the second charging step, positive charges reside at the interface between the generating layer and the overcoating layer; and further, there is a uniform layer of negative charges located at the interface between the hole injecting layer and the transport layer.

Thereafter, the photoresponsive device can be exposed to an imagewise pattern of electromagnetic radiation to which the charge carrier generating material is responsive enabling an electrostatic latent image to be formed. The electrostatic image formed may then be developed by conventional means resulting in a visible image, this development being accomplished by, for example, cascade, magnetic brush, liquid processing, and the like. The visible image is typically transferred to a receiver member by a conventional transfer technique, and permanently affixed thereto.

In a preferred embodiment of the present invention the silicone-silica hybrid materials are selected as overcoatings for three layered organic photoresponsive devices, reference U.S. Pat. No. 4,265,990, which devices are comprised of, for example a substrate, a generating layer, and a transporting layer; and amorphous selenium members.

The silicone-silica hybrid hard polymers of the present invention are soluble in solvents, such as alcohols, and thus can be conveniently coated from alcoholic solutions. Further, once the silicone-silica hybrid is crosslinked into its resinous state, it is no longer soluble, thus enabling it to withstand cleaning solutions such as ethanol. Additionally, because of their nature, photoresponsive devices with the silicone-silica polymers of the present invention can be utilized in liquid toner systems. Furthermore, inorganic or orgnic photoresponsive devices with the silicone-silica hybrid polymers of the present invention are humidity resistant.

The invention will now be described in detail with respect to specific preferred embodiments thereof, it being understood that these examples are intended to be illustrative only, and the invention is not intended to be limited to the materials, conditions, process parameters and the like recited herein. Parts and percentages are by weight unless otherwise indicated.

EXAMPLE I

There was prepared an overcoated inorganic photoresponsive member by coating an aluminum drum, about 3 mils in thickness, with a selenium arsenic alloy, containing about 99.5 percent selenium, and 0.5 percent arsenic, in a thickness of 60 microns. The resulting member was then initially covered with a 2 percent solution of a silicone hard coat primer commercially available from General Electric Corporation as SHP-200, over one-half of its entire area in a lengthwise manner, and in a dry box at 30 percent relative humidity. Subsequent to drying for 30 minutes, there was then applied a film of a silicone-silica hybrid crosslinked polymer, commercially available from Dow Corning Company as VESTAR Q-9, at 7.5 percent solids in a methanol/isopropanol mixture, by flow coating over the primer area of the photoresponsive device. The VESTAR solution contained 3 percent of potassium acetate which functions as an ambient temperature curing (crosslinking) catalyst for the VESTAR. The resulting photoresponsive device was then allowed to cure for 24 hours in a dry box resulting in a VESTAR film layer having a thickness of 1 micron.

The VESTAR silicone-silica film overcoating was resistant to both isopropanol and acetone, that is, these materials did not cause a dissolution of the film or adversely affect the film in any manner, indicating an adequate curing of the VESTAR had been achieved.

The portion of the above photoresponsive device with the VESTAR coating was utilized in the Xerox Corporation 3100® electrostatic xerographic imaging system, and excellent quality images, no background, of high resolution were obtained. Further, excellent transfer of the toner image to a paper substrate resulted, this transfer being approximately 100 percent, indicating the superior release characteristics of the VESTAR silicone silica hybrid polymer overcoating.

Additionally, subsequent electrical and print testing of the photoresponsive device with the Xerox Corporation 3100® machine system indicated little or no voltage cycle-up due to the VESTAR overcoating when compared to the uncoated arsenic selenium alloy area, and the generated final copies were of high quality equal to the quality of the copies obtained with the uncoated portion of the device.

EXAMPLE II

The procedure of Example I was repeated with the exception that there resulted a silicone silica hybrid crosslinked polymer overcoating having a thickness of 1.5 microns.

The resulting photoresponsive device was subjected to equivalent electrical testing and print testing as described in Example I, with substantially similar results. Further, the photoresponsive device was subjected to a stress wear test which involved tumbling abrasive uncoated sponge iron carrier beads, 100 microns in diameter, against the surface of the photoresponsive device, in a mechanical fixture for 50,000 simulated copies. Subsequent transmission electron micrograph analysis indicated no measurable wear was evident on the overcoated VESTAR portion of the photoresponsive device.

EXAMPLE III

Seven small samples of 50 micron thick arsenic selenium alloys were coated on aluminum in accordance with the procedure of Example I, followed by coating of the VESTAR silicone silica hybrid material in a thickness of 1.5 microns. These samples, along with several uncoated samples of 50 micron thick arsenic selenium alloys were exposed to mercury vapor for a period of about 72 hours. Subsequent analysis and visual observation indicated no crystallization of selenium had occurred with any of the seven samples coated with the VESTAR, while the uncoated selenium materials crystallized extensively.

EXAMPLE IV

There was prepared a sample of a temperature resistant organic photoreceptor comprised of an aluminized Mylar substrate 5 mils in thickness, overcoated with a generating layer of trigonal selenium in polyvinyl carbazole, about 2 microns in thickness, which was overcoated with a transport layer of N,N'-diphenyl N,N'-bis-(methylphenyl)-[1,1-bisphenyl]-4,4'diamine, dispersed in polycarbonate, 27 microns in thickness. A primer layer, thickness of 200 to 400 Angstroms, of polymethylmethacrylate was then applied to the transport layer by spray coating. The resulting member was then overcoated with the silicone silica hybrid crosslinked polymer of Example I, followed by thermally curing for three hours at 85° resulting in a final silicone silica hybrid coating of 1.5 microns.

The hot toner release characteristics of this device were tested by a transfix process, that is, simultaneously transfer and fixing by first generating a toner image on the photoreceptor, and then placing the surface with the image in contact with paper. The paper was placed downward onto a hot plate at a temperature of 120° C. A roller was then pressed across the photoreceptor sandwich paper to insure intimate contact with the toner in the melted state. The photoreceptor/paper was allowed to cool and the two are then separated by pulling the paper away. The paper now contained essentially 100 percent of the image while substantially no toner particles remained on the overcoated photoresponsive device.

EXAMPLE V

Amorphous selenium drums were overcoated with the silicon-silica hybrid polymer, SHC-1010, a dispersion of colloidal silica and a hydroxylated silsesquixone in an alcohol medium in the following manner. There was initially coated on the amorphous selenium photoreceptor surfaces a primer layer of a mixture of PE-200, a polyester available from Goodyear Rubber Corporation, and polymethylmethacrylate, 80/20, resulting in a coating thickness for the primer of 200 to 400 Angstroms. Thereafter, overcoating layers of silicone-silica hybrid coatings, SHC-1010, were applied to the primer by spray coating, the final thickness of the overcoat layer being 1 micron.

The resulting prepared overcoated selenium drum imaging members were then electrically tested at various relative humidities, and there was measured by electrostatic probes the charge in volts, $V_{ddp}$, and the residual voltage $V_r$ with the following results 1. At 70° F. and 20 percent relative humidity, the $V_{ddp}$ and $V_r$ (residual voltage) values in volts for the coated imaging member with a thickness of 1 micron were 995 volts and 130 volts.
2. At 80° F. and 75 percent relative humidity, the $V_{ddp}$ and $V_r$ values for the 1 micron imaging member were 815 volts and 20 volts, respectively.
3. In contrast, an identical imaging member with an overcoating thickness of 2 microns at 70° F. and 20 percent relative humidity had a $V_{ddp}$ and $V_r$ of 1240 volts, and 315 volts, respectively. Similarly, at 80° F. and 75 percent relative humidity for the imaging member with a 2 micron overcoating thickness the $V_{ddp}$ and $V_r$ voltages were 880 and 50, respectively.

Therefore, for example, with a thicker overcoating of 2 microns and at 20 percent relative humidity, the residual voltage $V_r$ is an unacceptably high 315 volts, which is much higher than the machine bias voltage can control, thus resulting in background printout. In contrast, a residual of 130 volts at 20 percent relative humidity, and 20 volts of 75 percent relative humidity with an overcoating thickness of 1 micron can be biased out in an imaging apparatus; and therefore, no undesirable background printout is generated.

Although the invention has now been described with respect to specific preferred embodiments, it is not intended to be limited thereto but rather those skilled in the art will recognize that variations and modifications may be made therein which are within the spirit of the invention, and the scope of the claims.

I claim:

1. A photoresponsive imaging member with acceptable residual voltages at from about 20 percent to about 80 percent relative humidities consisting essentially of inorganic or organic photoconductive substances, and as a release protective coating thereover a dispersion of colloidal silica and a hydroxylated silsesquixone in an alcoholic medium, which overcoating is of a thickness of from about 0.2 micron to about 1.5 microns.

2. An imaging member in accordance with claim 1 wherein the inorganic photoconductive substance is amorphous selenium or an amorphous selenium alloy.

3. An imaging member in accordance with claim 2 wherein the amorphous selenium alloy is selenium arsenic, or selenium tellurium.

4. A photoresponsive imaging member in accordance with claim 3 wherein the selenium arsenic alloy contains about 99.5 percent by weight of selenium, and 0.5 percent by weight of arsenic.

5. An organic layered photoresponsive imaging member with acceptable residual voltages at from about 20 percent to about 80 percent relative humidities, consisting essentially of a photogenerating layer containing therein a photogenerating pigment, and an aryl amine transport layer dispersed in an inactive resinous binder, the aryl amine being of the following formula

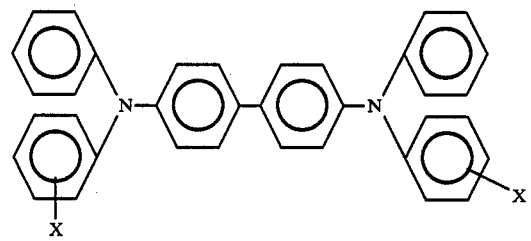

wherein X is selected form the group consisting of (ortho)$CH_3$, (meta)$CH_3$, (para)$CH_3$, (ortho)Cl, (meta)Cl, and (para)Cl, which member further contains thereover as a release protective overcoating a dispersion of colloidal silica and a hydroxylated silsesquixone in an alcoholic medium, and wherein the overcoating layer is of a thickness of from about 0.2 to about 1.5. microns.

6. An imaging member in accordance with claim 5 wherein the photogenerating pigment is trigonal selenium, or vanadyl phthalocyanine, and this layer is situated between a supporting substrate and the aryl amine charge transport layer.

7. An imaging member in accordance with claim 5 wherein the photogenerating pigment is trigonal selenium, a metal free phthalocyanine, a metal phthalocyanine, or vanadyl phthalocyanine.

8. An imaging member in accordance with claim 5 wherein X is alkyl or halogen.

9. An imaging member in accordance with claim 1 wherein the acceptable residual voltage is from about 10 to about 150 volts.

10. An imaging member in accordance with claim 1 wherein the thickness of the overcoating layer is 1 micron.

11. An imaging member in accordance with claim 5 wherein the thickness of the overcoating layer is 1 micron.

12. An imaging member in accordance with claim 1 further including therein a silicone primer in contact with the inorganic or organic photoconductive substance.

13. An imaging member in accordance with claim 5 further including a supporting substrate, and silicone primer in contact therewith.

14. An imaging member in accordance with claim 11 wherein the thickness of the overcoating layer is 1 micron.

* * * * *